US005824940A

United States Patent [19]

Chediak et al.

[11] Patent Number: 5,824,940

[45] Date of Patent: Oct. 20, 1998

[54] CERAMIC BULLET-PROOF FABRIC

[75] Inventors: Juan Alexander Chediak, Essex Junction, Vt.; Lincoln Clark Young, Alfred Station; Daniel Lee Edson, Sinclairville, both of N.Y.

[73] Assignee: Alfred University, Alfred, N.Y.

[21] Appl. No.: 790,749

[22] Filed: Jan. 27, 1997

[51] Int. Cl.[6] ..... F41H 5/02; F41H 1/02

[52] U.S. Cl. ..... 89/36.05; 89/36.02; 2/2.5

[58] Field of Search ..... 89/36.02, 36.05; 2/2.5; 428/911

[56] References Cited

U.S. PATENT DOCUMENTS 4,179,979 12/1979 Cook et al. ..... 89/36.02
4,911,061 3/1990 Pivitt et al. ..... 89/36.02
5,134,725 8/1992 Yeshurun et al. ..... 2/2.5
5,221,807 6/1993 Vives ..... 89/36.02
5,515,541 5/1996 Sacks et al. ..... 2/2.5

*Primary Examiner*—Michael J. Carone
*Assistant Examiner*—Matthew J. Lattig
*Attorney, Agent, or Firm*—Howard J. Greenwald

[57] ABSTRACT

A bullet-proof fabric containing a first layer of high-strength fabric, a first layer of ceramic material below the first layer of high-strength fabric, and a second layer of high-strength fabric disposed below the first layer of ceramic material. The first layer ceramic material contains a multiplicity of ceramic structures, each of which has a first orifice extending through it, and a means for fastening the ceramic structure disposed within the orifice.

19 Claims, 2 Drawing Sheets

CERAMIC BULLET-PROOF FABRIC

FIELD OF THE INVENTION

A flexible, bullet-proof fabric containing ceramic material which can withstand a projectile traveling at a speed of at least about 2,850 feet per second.

BACKGROUND OF THE INVENTION

Armor structures made from or containing ceramic material are well known in the art. By way of illustration, some typical structures are described in U.S. Pat. Nos. 5,443,917 (a ceramic armor material containing titanium nitride), 5,377,935 (a ceramic protective shield for space-craft), 5,371,049 (a ceramic composite made from silicon carbide and aluminum nitride), 5,361,678 (composite armor containing a plurality of ceramic bodies embedded in a metal matrix), 5,221,807 (ballistic armor plate), and the like. The disclosure of each of these patents is hereby incorporated by reference into this specification.

The E.I. DuPont de Nemours Corporation of Wilmington, Del. makes and sells "KEVLAR 129 vests", and they describe these vests in a publication entitled "Dress for Survival" (DuPont publication H-35629, revision 6/94). At page 4 of this publication, it is disclosed that "Personal body armor of KEVLAR is not designed to protect against high velocity centerfire rifle threats. Because of the higher velocities and different bullet configurations, heavier tactical armor is needed. Typically, these 'Tactical" or "Special Purpose' garments contain hardened steel or ceramic inserts and more KEVLAR than practical for concealable armor."

However, these "Tactical" or "Special Purpose" garments are relatively heavy, inflexible, and uncomfortable.

It is an object of this invention to provide a bullet-proof fabric which can withstand projectile velocities in excess of 2,850 feet and which can be made into garments which are relatively light and flexible.

SUMMARY OF THE INVENTION

In accordance with this invention, there is provided a bullet-proof fabric. A first layer of this fabric contains fiber with a tensile strength of at least about 425,000 pounds per square inch. Disposed below the first layer of fabric is a first layer of ceramic rings. Disposed below the first layer of ceramic rings is a second layer of fabric with fiber with a tensile strength of at least about 425,000 pounds per square inch.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
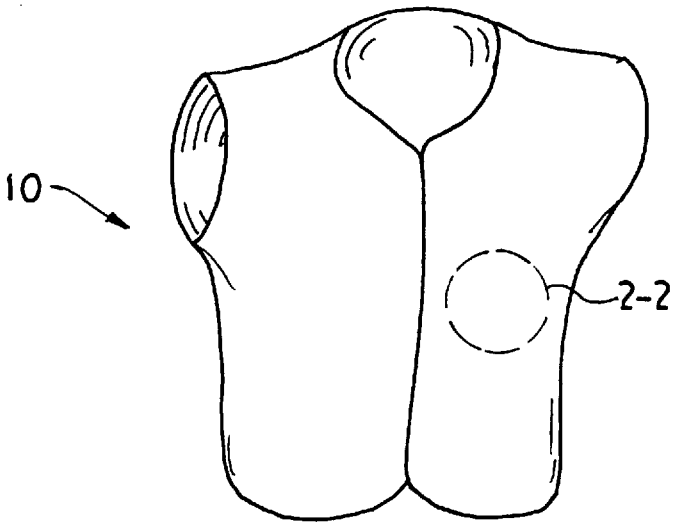
FIG. 1 is a perspective view of a vest made from the bullet-proof material of this invention.

FIG. 1 is a perspective view of a vest 10 which is comprised of or consists essentially of the bullet-proof fabric material of this invention. It is preferred that the vest consist essentially of the bullet-proof fabric material of this invention.

As will be apparent to those skilled in the art, other fabric structures can advantageously utilize applicant's bullet-proof fabric material. Thus, one may construct a bullet-proof tent (not shown), a bullet-proof tarpaulin (not shown), a bullet-proof shield (not shown), and the like.

Figure 2:
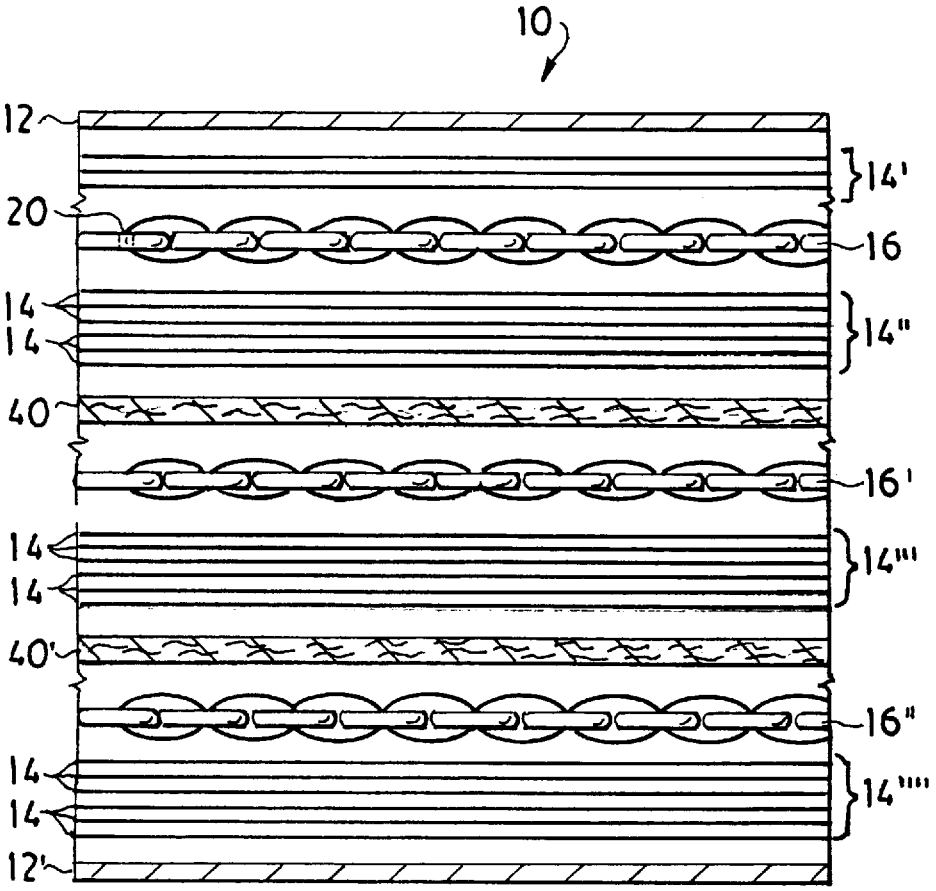
FIG. 2 is an exploded sectional view of a portion of the vest of FIG. 1.

FIG. 2 is an exploded sectional view, taken along lines 2—2 of FIG. 1, of one preferred embodiment of applicant's fabric.

Referring to FIG. 2, and in the preferred embodiment depicted therein, it will be seen that the top layer 12, as well as the bottom layer 12, of fabric 10, is a layer of waterproof fabric.

Waterproof fabric is well known to those skilled in the art and is readily commercially available. Thus, e.g., one may use any of the waterproof fabrics described in U.S. Pat. Nos. 5,444,898, 5,326,632 (moisture permeable waterproof fabric), 5,207,662, 4,803,116, 4,539,255, 4,537,817, 3,675,391 (breathable waterproof fabric), 3,481,821, and the like. The disclosure of each of these United States patents is hereby incorporated by reference into this specification.

In one preferred embodiment, the waterproof fabric prevents the transmission of substantially all of light energy at a wavelength of from about 100 to about 4000 angstroms.

The use of waterproof fabric 12 is optional, but it is preferred that some means be used to prevent water from contacting fabric layer 14. Thus, one may use alternative means of providing such waterproofing.

One such alternative means, not shown, is the use of a waterproof coating applied to fabric layer 14. Waterproof coatings for fabric materials are known to those skilled in the art and are described, e.g., in U.S. Pat. Nos. 5,431,979 (waterproof coatings for woven fabrics), 4,695,484 (moisture permeable waterproof coatings), 4,256,804, 4,146,672, 3,506,734, and the like. The disclosure of each of these United States patents is hereby incorporated by reference into this specification.

In one preferred embodiment, the waterproof coating is "ZEPEL," which is a fluorocarbon textile finish sold by the E.I. DuPont deNemours & Company of Wilmington, Delaware.

Disposed below the waterproof fabric 12, or the waterproof coating (not shown), is at least one layer of a high-tensile strength, impact resistant fabric 14. In the composite structure 10 illustrated in FIG. 2, four layers 14', 14", 14'", and 14"" of this fabric material are shown. However, in another embodiment (not shown), only layer 14' is used. In yet another embodiment (not shown), both layers 14' and 14" are used. In yet another embodiment (not shown), layers 14', 14", and 14'" are used.

Referring again to FIG. 2, layer 14' has at least one sheet of the high-tensile strength fabric 14. It is preferred that layer 14' contain at least three sheets of the high-tensile strength fabric 14.

When an additional layer 14" is used, it is preferred that it contain at least one sheet of high-tensile strength fabric 14 and, more preferably, from about 6 to about 12 sheets of high-tensile strength fabric 14.

When an additional layer 14'" is used, it is preferred that it contain at least one sheet of high-tensile strength fabric 14 and, more preferably, from about 6 to about 12 sheets of high-tensile strength fabric 14.

When an additional layer 14"" is used, it is preferred that it contain at least one sheet of high-tensile strength fabric 14 and, more preferably, from about 6 to about 12 sheets of high-tensile strength fabric 14.

Each sheet of high-tensile strength fabric 14 is comprised of at least about 90 weight percent of high-strength fiber with a tensile strength of at least about 425,000 pounds per square inch and a density less than 1.6 grams per cubic centimeter. In one embodiment, the basis weight of the fabric 14 ranges from about 5 to about 21 ounces per square yard.

In one embodiment, each sheet of high-tensile strength fabric 14 consists essentially of high-strength fiber with a tensile strength of at least about 425,000 pounds per square inch.

In one embodiment, the high-tensile strength fabric 14 consists essentially of "KEVLAR," which is an aromatic polyamide fiber sold by the E.I. DuPont deNemours Company of Wilmington, Del. This material is well known and is described in U.S. Pat. Nos. 5,438,908, 5,438,753, 5,425,142, 5,395,671 (composite fabric made up of layers of nonwoven and woven Kevlar fabric with an areal density of less than 1.15 pounds), 5,392,686 (bullet-proof plastic fabric), 5,370,035, 5,301,806, and the like. The disclosure of each of these United States patents is hereby incorporated by reference into this specification.

In one embodiment, the "KEVLAR" fabric is woven.

Means of utilizing "KEVLAR" fabric in various constructions are well known and are described in the following E.I. DuPont deNemours publications: "A Guide to Designing and Preparing Ballistic Protection of Kevlar Aramid" (publication E-53162, January, 1983), "Kevlar: Dress for Survival" (publication H-35629, June, 1994), "Leading the Way with Kevlar Aramid Technology" (publication H-50690, undated), and the like.

Referring again to FIG. 2, disposed below fabric layer 14' is ceramic layer 16. The composite fabric 10 may have only 1 ceramic 16, or 2 ceramic layers 16, or three or more ceramic layers 16. It is preferred to use from 2 to 4 such ceramic layers 16.

Figure 3:
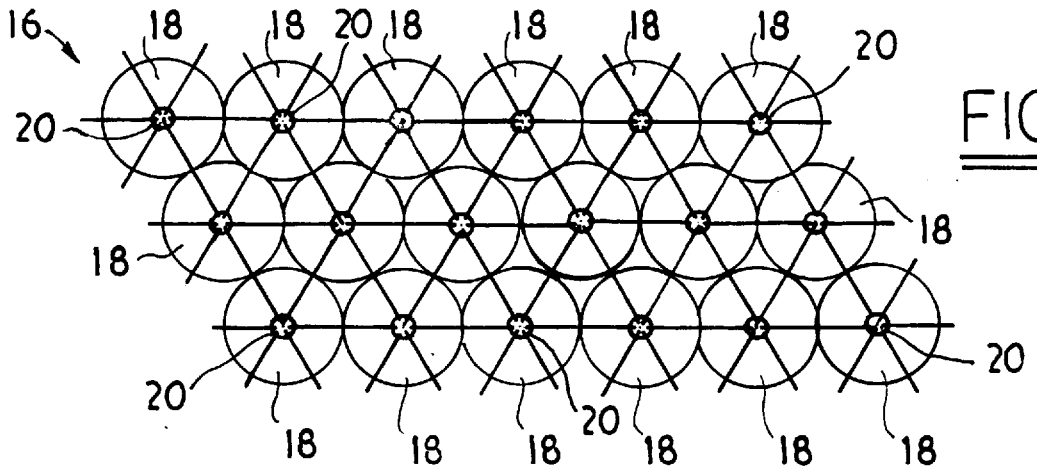
FIG. 3 is a top view of one embodiment of the ceramic ring structure used in the vest of FIG. 1.

FIG. 3 is a top view of one preferred ceramic layer 16. Referring to FIG. 3, and in the preferred embodiment depicted therein, it will be seen that ceramic layer 16 is comprised of ceramic structures 18 which, in the embodiment depicted, are preferably connected with thread 20. In one embodiment, thread 20 consists essentially of high strength fiber with a tensile strength of at least about 425,000 pounds per square inch.

As will be apparent to those skilled in the art, other means may be used to connect the ceramic structures 18 to each other and/or to the layer 14' and/or 14" and/or 14'" and/or 14"". Thus, e.g., one may so connect the ceramic structures by means of epoxy adhesive, rivets, and the like.

Referring again to FIG. 3, in the embodiment depicted, substantially all of the ceramic structures 18 have substantially circular cross-actions and contain an orifice 20 through each of the middle portions. Other embodiments of these ceramic structures are illustrated in FIGS. 4 et seq.

Figure 4:
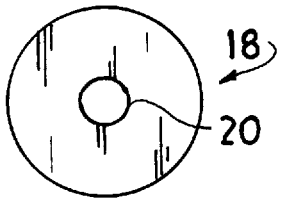
FIGS. 4, 5, 6, 7, 8, and 9 are top views of various ceramic structures which can be used in the ceramic ring structure of FIG. 3.
Figure 5:
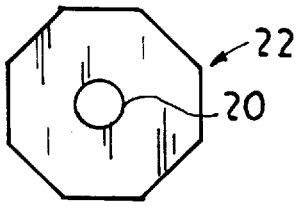
Figure 6:
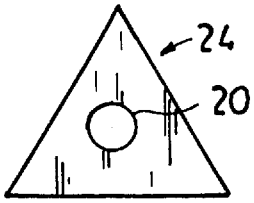
Figure 7:
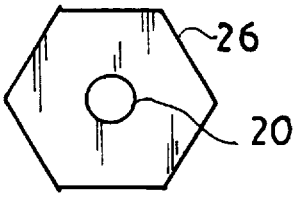
Figure 8:
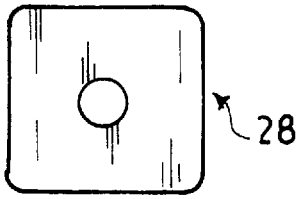

FIG. 4 illustrates the ceramic structure 18 used in the embodiment of FIG. 3. FIG. 5 illustrates an octagonal ceramic structure 22. FIG. 6 illustrates a triangular ceramic structure 24. FIG. 7 illustrates a hexagonal ceramic structure 26. FIG. 8 includes a rectangular ceramic structure 28 with no central orifice 20.

Figure 9:
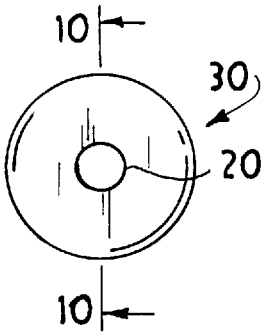
Figure 10:
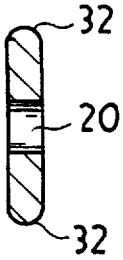
FIG. 10 is a sectional view of the ceramic structure of FIG. 9.

FIG. 9 illustrates a substantially circular ceramic structure with rounded edges 32 (see FIG. 10). Without wishing to be bound by any particular theory, applicants believe that the use of such rounded edges 32 allows the fabric 10 to be more flexible. As will be apparent to those skilled in the art, such rounded edges may be used with any one or all of the structures of FIGS. 4–11.

Figure 11:
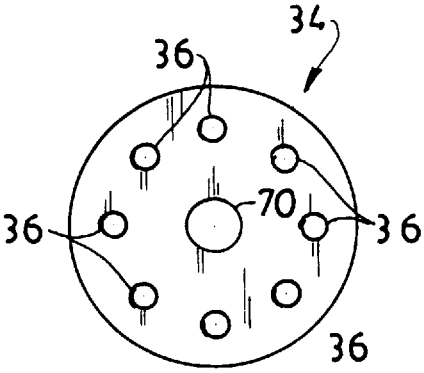
FIG. 11 is another ceramic structure which can be used in the ceramic ring layer.

FIG. 11 illustrates a substantially circular ceramic structure 34 with a multiplicity of orifices 36. The use of these multiplicity of orifices 36 tends to reduce the weight of the ceramic layer 16 and can be employed with any of the structures of FIGS. 4 through 11.

In one embodiment, each of ceramic structures 18, 22, 24, 26, 28, 30, 32, and 34 is comprised of at least 90 weight percent of ceramic and, preferably, at least about 95 weight percent of ceramic. In one embodiment, each of such structures consists essentially of ceramic material.

In another embodiment, not shown, each of such ceramic structures 18, 22, 24, 26, 28, 30, 32, and 34 contains ceramic material admixed with a metal matrix. In yet another embodiment, each of such ceramic structures 18, 22, 24, 26, 28, 30, 32, and 34 contains ceramic material with metal backing. In yet another embodiment, each of such ceramic structures 18, 22, 24, 26, 28, 30, 32, and 34 includes ceramic material admixed with fibrous material which may, but need not be, ceramic.

Referring again to FIGS. 3–11, it is preferred that the ceramic material used in ceramic structures 18, 22, 24, 26, 28, 30, 32, and 34 have a Young's Modulus of at least about 10,000,000 pounds per square inch, a porosity less than 20 volume percent, and toughness less than about 6 megaPascals—meters$^{0.5}$. In a more preferred embodiment, the ceramic material used in ceramic structures 18, 22, 24, 26, 28, 30, 32, and 34 has a Young's Modulus of at least about 50,000,000 pounds per square inch, a porosity less than 10 volume per cent, and a toughness less than about 5 megaPascals—meters$^{0.5}$.

By way of illustration and not limitation, some suitable ceramic materials include alumina, zirconia, silicon nitride, titanium nitride, boron carbide, titanium diboride, silicon carbide, and the like. By way of further illustration, other suitable ceramic materials are described in U.S. Pat. Nos. 5,443,917, 5,377,935, 5,371,049, 4,953,442, 4,911,061, 4,138,456, 3,859,892, 3,832,266, 3,794,551, 3,683,828, and the like. The disclosure of each of these patents is hereby incorporated by reference into this specification.

It is preferred that each of ceramic structures 18, 22, 24, 26, 28, 30, 32, and 34 have a cross-sectional area less than about 9.0 square inches and, more preferably, less than about 2.0 square inches.

Referring again to FIG. 2, it is preferred that each of ceramic layers 16 contain at least 2 of one or more of ceramic structures 18, 22, 24, 26, 28, 30, 32, and 32 and, additionally, contain from about 16 to about 200 of such structures per square foot of surface area of layer 16. As will be apparent to those skilled in the art, each of the layers 14 and 16 may differ from the other layers 14 and/or 16 in thickness, width, length, etc.

Referring again to FIG. 2, disposed below ceramic layer 16 is a second high-strength fiber layer 14" and, below that, an optional layer of padding 40. The padding is preferably a compressible fabric such as, e.g., cotton batting, sorbethane, nylon, and the like. These compressible fabrics are very well known and are described, e.g., in U.S. Pat. Nos. 5,364,683, 5,336,346, 5,334,418, and the like. The disclosure of each of these United States patents is hereby incorporated by reference into this specification.

It is preferred that compressible fabric layer 40 be from about 0.1 to about 0.5 inches in width.

Referring again to FIG. 2, one may, but need not, utilize a second ceramic layer 16', and/or a third high-strength fiber layer 14''', and/or a second padding layer 40', and/or a third ceramic layer 16", and/or a fourth high-strength fiber layer 14"", and/or a second waterproof layer 12'.

The following examples are presented to illustrate the claimed invention but are not to be deemed limitative thereof. Unless otherwise specified, all parts are by weight, and all temperatures are in degrees Centigrade.

EXAMPLE 1

A "KEVLAR" fabric which was identified as "type 840 denier Kevlar 129, fabric style 1019/1" was purchased from the Fabric Development Company of 1217 Mill Street, Quaker town, Pa. This fabric was cut into 19 c.m.×19 c.m. squares.

Referring to FIG. 1, six of these fabric squares were aligned and sewn together around their edges to produce layer 14'. Additionally, layers 14", 14''', and 14"" were made by similarly aligning and sewing together 6, 6, and 8 such fabric squares, respectfully.

The ceramic structures 20 were made by mixing 3,000 grams of A-16 alpha alumina with 22.5 grams of "DARVAN 821A" (an anionic surfactant sold by the R. T. Vanderbilt Company, Inc. of Norwalk, Conn.) and 750 grams of deionized water. The suspension was ball milled over a period of about 12 hours in a large porcelain milling jar with small media. Thereafter, ninety grams of polyethylene glycol (20M) was added to the suspension, and this mixture was then ball milled in the same device for an additional two hours.

The suspension thus produced was spray dried, thereby separating the particles into a coarse and fine fraction. The fraction of coarse particles were then used to press green bodies.

A substantially cylindrical die with a diameter of 2.54 centimeters and a depth of 4 inches was used; the die was made from mild steel. A rod with a diameter of 3 millimeters was inserted in the center of the die to form orifice 20. 9.4 grams of the coarse spray-dried powder were pressed into the die. This process was repeated to form a 168 of such green bodies.

The green bodies were fired in an electric kiln under ambient atmosphere. The temperature of the kiln was raised from ambient to 900 degrees Centigrade at a rate of 5 degrees Centigrade per minute, and then it was raised to 1,375 degrees Centigrade at a rate of 10 degrees Centigrade per minute, and then it was raised to 1,500 degrees Centigrade at rate of 2 degrees Centigrade per minute, and then it was raised to 1,600 degrees Centigrade at a rate of 1 degree Centigrade per minute, and then it was soaked at 1,600 degrees Centigrade for 24 minutes, and then it was allowed to cool to room temperature.

The fired pellets had outer diameters of 2.1 centimeters and thicknesses of 0.68 centimeters. They were sewn together with "KEVLAR" thread using a single piece of thread into a line. Seven rings were sewn together using a single piece of thread into a line. Glue was used to fasten the ends of the thread to itself. Each ring had at least two thicknesses of thread holding it to the pellets on either side. Two rows of seven pellets were then sewn to each other using a single piece of thread. Two of these sets of two, and then two of those sets of four, were likewise sewn together until the layer contained eight rows of seven pellets sewn tightly together in a close packed array. Three such layers were made from the 168 pellets that were pressed.

The layers 14', 16, and 14", 16', 14''', 16", and 14"" (see FIG. 2) were joined by aligning these layers and then sewing the perimeters of the layers 14', 14", 14''', and 14"". The fabric so produced was taped to a three inch thick piece of split oak and shot at with a bullet from a high power 25–06 rifle at 48 feet; the projectile, with a mass of 87 grains, at impact, had an estimated velocity of at least 3,500 feet per second.

The fabric was examined. The projectile was completely destroyed. The parts into which it broke, and the ceramic parts it shattered, penetrated through the third layer 14''', and through the first three sheets of layer 14"", but not beyond.

Comparative Example 2

A "KEVLAR" fabric which was identified as "type 840 denier Kevlar 129, fabric style 1019/1" was purchased from the Fabric Development Company of 1217 Mill Street, Quakertown, Pa. This fabric was cut into 19 c.m.×19 c.m. squares.

Thirty of these "KEVLAR" squares were aligned and sewn together. Thereafter, the composite structure thus produced was taped to a three inch thick piece of split oak and shot at with a bullet from a high power 25–06 rife at 48 feet; the projectile, with a mass of 87 grains, at impact, had an estimated velocity of at least 3,500 feet per second.

The fabric structure was examined. The projectile penetrated each of the thirty sheets of the "KEVLAR" squares and, additionally, the 3.0" piece of split oak.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A bullet-proof fabric comprising a first layer of high-strength fabric, a first layer of ceramic material disposed below said first layer of high-strength fabric, and a second layer of high-strength fabric disposed below said first layer of ceramic material, wherein:

(a) each of said first layer high-strength fabric and said second layer of high-strength fabric is comprised of one sheet of high strength fabric, wherein said sheet of high-strength fabric is comprised of at least about 90 weight percent of fiber with a tensile strength of at least about 425,000 pounds per square inch and a density of less than 1.6 grams per cubic centimeter;

(b) said first layer of ceramic material is comprised of a multiplicity of ceramic structures, wherein:

1. each of said ceramic structures is comprised of a first orifice extending through said ceramic structure,
2. a means for fastening said ceramic structure is disposed within said first orifice,
3. said first layer of ceramic material contains from about 16 to about 200 of said ceramic structures for each square foot of surface area of said first layer of ceramic material, and
4. each of said ceramic structures is comprised of at least about 90 weight percent of ceramic material, wherein said ceramic material has a Young's modulus of at least about 10,000,000 pounds per square inch, a porosity of less than 20 volume percent, and a toughness of less than about 6 megaPascals—meters$^{0.5}$.

2. The bullet-proof fabric as recited in claim 1, wherein said fastener is a thread.

3. The bullet-proof fabric as recited in claim 2, wherein said thread has a tensile strength of at least 425,000 pounds per square inch.

4. The bullet-proof fabric as recited in claim 1, wherein each of said ceramic structures has a top surface and a bottom surface, and wherein said orifice extends from said top surface to said bottom surface.

5. The bullet-proof fabric as recited in claim 1, wherein each of said orifice extends from one side of each of said ceramic structures to another side of each of said ceramic structures.

6. The bullet-proof fabric as recited in claim 1, further comprising a layer of waterproof fabric disposed above said first layer of high-strength fabric.

7. The bullet-proof fabric as recited in claim 6, further comprising a layer of waterproof fabric disposed below said second layer of high-strength fabric.

8. The bullet-proof fabric as recited in claim 7, wherein said waterproof fabric prevents the transmission of substantially all light energy having a wavelength of from about 100 to about 4,000 angstroms.

9. The bullet-proof fabric as recited in claim 1, wherein said first layer of high-strength fabric is coated with a waterproof coating.

10. The bullet-proof fabric as recited in claim 1, wherein each of said ceramic structures has a substantially circular cross-sectional shape.

11. The bullet-proof fabric as recited in claim 10, wherein each of said ceramic structures comprises a multiplicity of orifices.

12. The bullet-proof fabric as recited in claim 10, wherein each of said ceramic structures has rounded edges.

13. The bullet-proof fabric as recited in claim 1, wherein each of said ceramic structures has a substantially rectangular cross-sectional shape.

14. The bullet-proof fabric as recited in claim 1, wherein each of said ceramic structures has a substantially octagonal cross-sectional shape.

15. The bullet-proof fabric as recited in claim 1, wherein said first layer of high-strength fabric consists essentially of woven fabric.

16. The bullet-proof fabric as recited in claim 1, wherein said second layer of high-strength fabric consists essentially of woven fabric.

17. The bullet-proof fabric as recited in claim 1, wherein each of said ceramic structures consists essentially of ceramic material.

18. The bullet-proof fabric as recited in claim 1, wherein each of said ceramic structures has a cross-sectional area of less than about 9.0 square inches.

19. The bullet-proof fabric as recited in claim 1, wherein each of said ceramic structures has a cross-sectional area of less than about 2.0 square inches.

* * * * *